US008835841B2

(12) United States Patent
Hashimoto et al.

(10) Patent No.: US 8,835,841 B2
(45) Date of Patent: Sep. 16, 2014

(54) MASS SPECTROMETER AND MASS SPECTROMETRY

(75) Inventors: Yuichiro Hashimoto, Tachikawa (JP); Hideki Hasegawa, Tachikawa (JP); Masuyuki Sugiyama, Hino (JP); Hiroyuki Satake, Kokubunji (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/519,587

(22) PCT Filed: Dec. 22, 2010

(86) PCT No.: PCT/JP2010/007411

§ 371 (c)(1),
(2), (4) Date: Jun. 28, 2012

(87) PCT Pub. No.: WO2011/080895

PCT Pub. Date: Jul. 7, 2011

(65) Prior Publication Data

US 2012/0292495 A1 Nov. 22, 2012

(30) Foreign Application Priority Data

Dec. 28, 2009 (JP) ..... 2009-296683

(51) Int. Cl.
*H01J 49/42* (2006.01)

(52) U.S. Cl.
CPC ..... *H01J 49/423* (2013.01)
USPC ..... 250/292; 250/396 R

(58) Field of Classification Search
USPC ..... 250/292, 281, 282, 396 R
See application file for complete search history.

(56) References Cited

U.S. PATENT DOCUMENTS

| | | | | |
|---|---|---|---|---|
| 5,420,425 | A | 5/1995 | Bier et al. | |
| 5,847,386 | A | 12/1998 | Thomson et al. | |
| 6,177,668 | B1 | 1/2001 | Hager | |
| 6,417,511 | B1 * | 7/2002 | Russ et al. | 250/292 |
| 6,838,666 | B2 | 1/2005 | Ouyang et al. | |
| 6,967,323 | B2 * | 11/2005 | Hashimoto et al. | 250/281 |
| 6,995,366 | B2 | 2/2006 | Franzen | |
| 7,019,290 | B2 * | 3/2006 | Hager et al. | 250/292 |
| 7,446,310 | B2 * | 11/2008 | Kovtoun | 250/282 |
| 7,982,182 | B2 * | 7/2011 | Hashimoto et al. | 250/282 |
| 8,227,748 | B2 * | 7/2012 | Berg et al. | 250/283 |
| 8,258,470 | B2 * | 9/2012 | Sheehan | 250/292 |
| 2004/0135080 | A1 | 7/2004 | Ouyang et al. | |
| 2005/0017167 | A1 | 1/2005 | Franzen | |
| 2007/0181804 | A1 | 8/2007 | Hashimoto et al. | |
| 2008/0073497 | A1 | 3/2008 | Kovtoun | |

FOREIGN PATENT DOCUMENTS

| | | |
|---|---|---|
| JP | 11-510946 | 9/1999 |
| JP | 2005-44594 | 2/2005 |
| JP | 2008-130469 | 6/2008 |
| JP | 2009-289560 | 12/2009 |
| JP | 2009-544118 | 12/2009 |

* cited by examiner

*Primary Examiner* — Kiet T Nguyen
(74) *Attorney, Agent, or Firm* — Antonelli, Terry, Stout & Kraus, LLP.

(57) ABSTRACT

A mass spectrometer possessing both high resolution and durability in a simple, compact structure compared to mass spectrometers of the related art, and characterized in possessing a linear ion trap unit containing a multipolar rod electrode including rod electrodes having fine orifices to allow passage of electrons or ions; a mechanism to move the ions inside the linear ion trap unit along the axis of the multipolar rod electrode; and a detector to selectively detect by mass, ions ejected from the linear ion trap unit.

28 Claims, 10 Drawing Sheets

MASS SPECTROMETER AND MASS SPECTROMETRY

TECHNICAL FIELD

The present invention relates to a mass spectrometer.

BACKGROUND ART

Linear ion traps with the feature of high sensitivity are widely utilized in mass spectrometers. Among such linear ion traps, a linear ion trap type comprised of four rod electrodes capable of trapping (trap capacity) a large quantity of ions within the interior at one time compared to 3-dimensional quadrupole ion traps of the related art and capable of high sensitivity analysis is in wide use.

Patent literature 1 discloses a method for selectively ejecting ions by mass in a direction orthogonal to the rod electrode from a slit formed in the rod electrode after having accumulated the ions in a linear ion trap. Patent literature 1 also discloses a method for generating ions within the linear ion trap by injecting electrons into the interior of the ion trap. A toroid linear ion trap is also disclosed.

Patent literature 2 discloses a method for selectively ejecting ions by mass along the axial direction of the rod by utilizing a fringing field generated between the end electrodes and rod electrodes, after accumulating ions in the linear ion trap and carrying out operations such as isolation and dissociation.

Patent literature 3 discloses a method for mass-selectively ejecting ions along the axial direction of the rod by utilizing a DC field generated among the wire electrodes after accumulating ions in the linear ion trap and carrying out operations such as isolation and dissociation.

Patent literature 4 discloses a method for forming rod electrodes for a linear ion trap comprised of planar electrodes. Patent literature 4 further discloses a method for mass-selectively ejecting ions radially after injecting electrons from the radial direction to generate ions in the interior of the linear ion trap.

Patent literature 5 discloses a method for selectively ejecting ions by mass along the radius after causing an electron trapping-dissociation reaction by injecting electrons into the interior of the linear ion trap to react with the ions inside the linear ion trap.

CITATION LIST

Patent Literature

Patent literature 1: U.S. Pat. No. 5,420,425
Patent literature 2: U.S. Pat. No. 6,177,668
Patent literature 3: US Patent Publication No. 2007-0181804
Patent literature 4: U.S. Pat. No. 6,838,666
Patent literature 5: U.S. Pat. No. 6,995,366

SUMMARY OF INVENTION

Technical Problem

The technology disclosed the patent literature 1 through 5 has the problem of disruptions in the electric field caused by electrons generated by the ionization source or neutral molecules within the sample adhering to the rod electrodes of the linear ion trap. More specifically, making long-term measurements causes stains or contamination to adhere to the electrode surface which appears as poor or deteriorated resolution. The technology disclosed the patent literature 1, 4, and 5 has the problem that noise occurs due to light generated from the electron source penetrating into the detector.

Solution to Problem

To resolve the aforementioned problems, the mass spectrometer possesses the unique features of a linear ion trap unit comprised of a multipolar rod electrode including rod electrodes formed with an orifice for passing the electrons or ions; a mechanism for moving the ions within the linear ion trap unit along the axial direction of the multipolar rod electrode; and a detector for detecting ions selectively ejected by mass from the linear ion trap unit.

A mass spectrometry is uniquely featured in including a step of passing the electrons or ions through an orifice formed in the rod electrode configuring the linear ion trap unit, a step of generating an axial electric field in the linear ion trap unit and moving the ions within the ion trap unit along the axial direction, a step of selectively ejecting the ions by mass from the linear ion trap unit, and a step of detecting the ejected ions.

Advantageous Effects of the Invention

The present invention renders the effect of both durability and high-resolution in a compact and simple design.

DESCRIPTION OF EMBODIMENTS

First Embodiment

Figure 1:
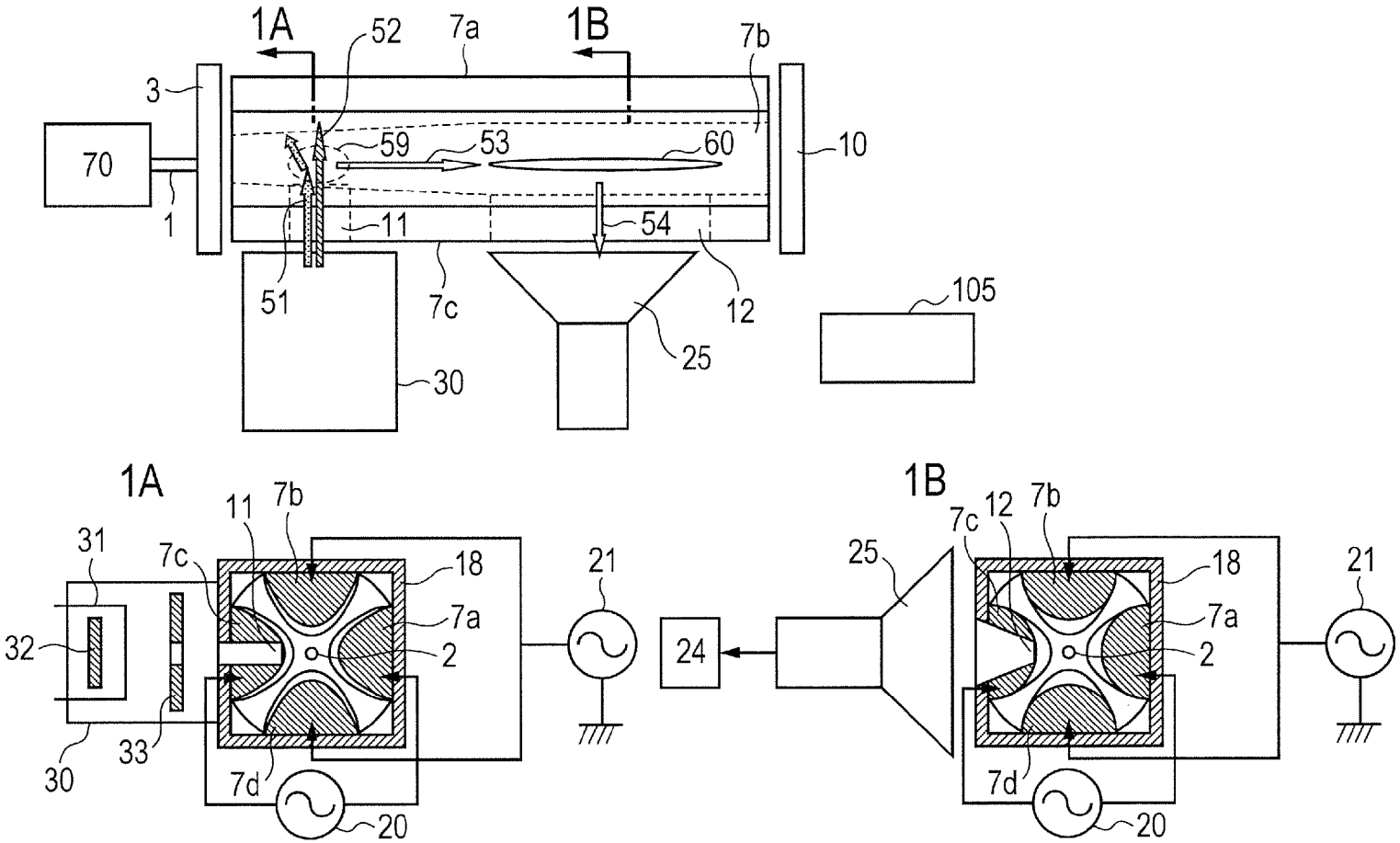
FIG. 1 is a drawing showing a first embodiment of the present method.

FIG. 1 is structural drawings of the linear ion trap of the present method. In this embodiment the linear ion trap contains a control unit/data collector unit 105 to regulate the voltages and collect data. A sample gasified by a gas sampling unit 70 is supplied by way of a heated capillary 1 through the orifice 2 to the interior of a linear ion trap comprised of an incap electrode 3, a rod electrode 7 and an endcap electrode 10. A gas chromatograph capillary may be utilized as the capillary. In this case separation can be accomplished by controlling the capillary temperatures. In order to ionize the gasified sample, an electron source 30 supplies the electrons to the linear ion trap in a movement direction 51. The electron source 30 is comprised of an electrode 32, a lens 33 and a filament 31 such as tungsten wire (FIG. 1A). Adjusting the voltage potential on the filament 31 to approximately −20 to −100 volts relative to the linear ion trap makes the electrons pass through the orifice 11 formed in the rod electrode, and supplies the electrons into the interior of the linear ion trap. The electrons supplied so as to follow the movement direction 51 react with the specimen gas supplied from the capillary 1 and generate ions in the ionizing region 59. This type of electron ionizing is called electron impact ionization. Besides electrons from the electron source 30, neutral gas and light emitted from the filaments are supplied via the orifice 11 and possess linearity along the movement direction 52. Electrons not contributing to ionization are diffused by the RF electric field within the trap. The neutral gas and diffused electrons adhering to the electrode cause contamination on the electrode. Continuing to ionize a location while still in this state is known to cause the resolution to deteriorate. Moreover, light entering the detector is known to cause noise.

The generated ions on the other hand are trapped radially by a quadrupole electric field radially generated by applying a trap RF voltage 21 at 1 to 4 megahertz and a maximum amplitude of approximately one kilovolt to the rod electrode 7. The present embodiment utilizes rod electrode 7 whose nearest distances axially from the central axis are different. The endcap electrode side for example is a distance farther away from the center axis than the incap electrode side. This placement generates an electric potential gradient along the axis from the incap electrode side to the endcap electrode side. The ions generated by this axial field move as shown by the movement direction 53 and move to the ion trap region 60. The ions that moved to the ion trap region 60 can be selectively ejected radially (along the radial direction 54) according to their specific mass number by applying a trap RF voltage 21 and a supplemental AC voltage 20. These ions ejected selectively according to their mass, pass through the slit 12 and are detected by a detector 25 comprised of an electron multiplier, etc. The signal acquired by the detector 25 is sent to the data collector unit 24 for detection signals. The incap electrode traps ions along the axis by applying a direct current voltage to the endcap electrode.

Utilizing a cover 18 of insulating material on the linear ion trap as shown in FIG. 1A and FIG. 1B can provide a high degree of external control of the gas pressure in the linear ion trap unit. The internal pressure is maintained between approximately $10^{-2}$ Pa to 1 Pa within the ion trap. The gas types used may include air, nitrogen, argon, helium and so on but utilizing helium that has a low molecular mass can provide high resolution.

Figure 2:
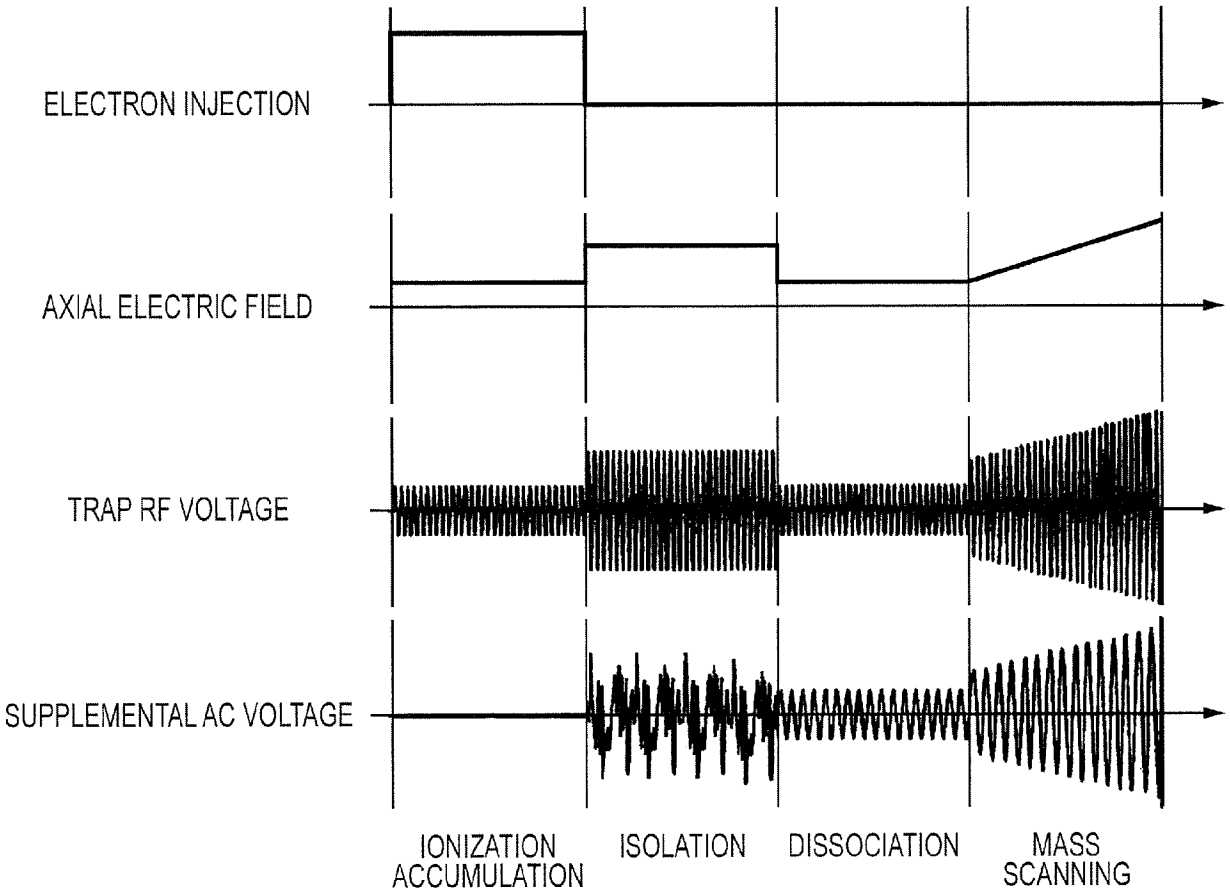
FIG. 2 is a drawing showing the measurement sequence of the first embodiment of the present method.

The measurement sequence when conducting tandem mass spectrometric (MS/MS) analysis in the linear ion trap in FIG. 1 is described next while referring to FIG. 2. The mass spectrometric (MS/MS) analysis sequence is comprised of four steps including: an ionizing and accumulation step to ionize and accumulate ions from the injection of electrons; an isolation step to eject all ions other than ions of a specific mass outside the trap by applying a FNF (filtered noise field) waveform (maximum amplitude of approximately 15 volts) that is the summed component of an RF voltage of approximately 1 to 500 kHz serving as the supplemental AC voltage 20 across the opposing rod electrodes (7*a*, 7*c*); a dissociation step to dissociate or separate ions remaining in the ion trap by applying an RF voltage at a maximum amplitude of approximately five volts and a frequency of 70 kHz as the supplemental AC voltage 20 across the opposing rod electrodes (7*a*, 7*c*); and a mass scanning step to selectively eject and detect ions by mass in order from ion with a low mass number to ions with a high mass number by scanning (sweeping) the amplitude of the trap RF voltage 21 and the supplemental AC voltage 20 at a frequency of approximately 300 kHz. A product spectrum can in this way be obtained of the fragment ions generated from parent ions of a specific mass. Performing electron injection in the ionizing and accumulation sequence instead of during mass scanning has the advantage that the noise caused by light generated by the ionization source can be reduced. Moreover, omitting the isolation step and the dissociation step from this sequence allows acquiring the MS1 spectrum, or also acquiring the MS3 spectrum by repeating this sequence once more.

Figure 3:
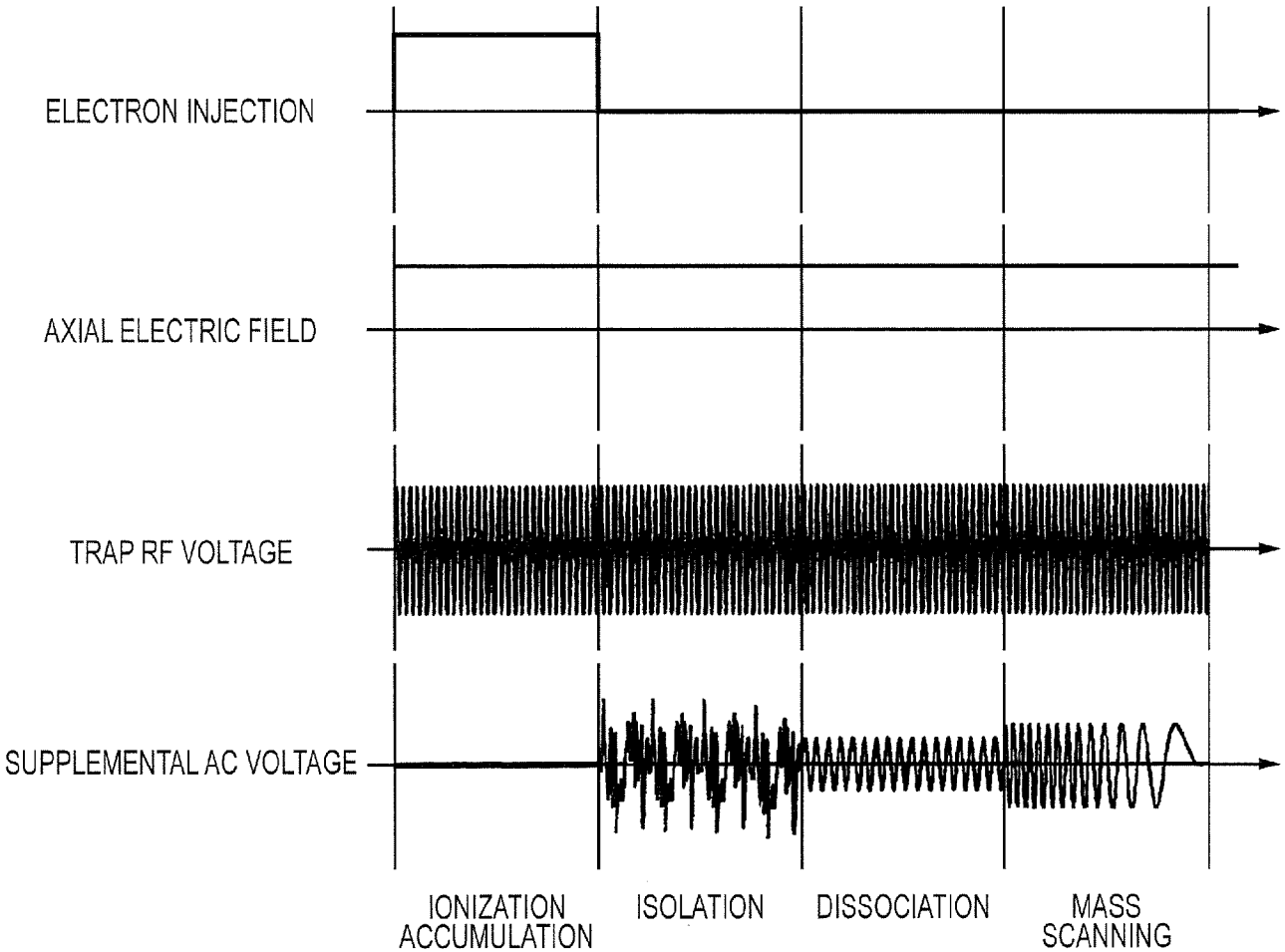
FIG. 3 is a drawing showing the measurement sequence of the first embodiment of the present method.

The other measurement sequences during MS/MS analysis of the linear ion trap are described next while referring to FIG. 3. Unlike the measurement sequence in FIG. 2, this measurement sequence can maintain a fixed RF voltage amplitude so that the maximum power consumption used for generating the RF electric field can be suppressed to a lower figure and a satisfactory structure achieved in a compact device. The frequency of the trap RF voltage however utilizes a high value of 2 MHz or more (preferably 3 MHz to 4 MHz) in order to obtain a mass range capable of good resolution in one scan. This sequence is comprised of four sequences, however other large significant differences are the utilizing of a fixed trap RF amplitude and the scanning (sweep) of the supplemental AC voltage frequency in the mass scan step. By sequentially scanning the supplemental AC voltage frequency from a high frequency of approximately 1 MHz to a low frequency of approximately 50 kHz in the scanning step, the ions can be selectively ejected and detected by mass in the order of ions with a low mass number to ions with a high mass number.

Utilizing the device as shown in FIG. 1 provides the following described advantages compared to the device design known in the related art. Electron injection in the related art accumulates ions and ejects ions at that same point and so possesses the problems that the quadrupole electric field utilized in mass dissociation (or separation) deforms due to contamination caused by electrons and neutral gas, and that the resolution deteriorates along with a long measurement (analysis) time. In the present embodiment however, though just the ions move axially towards the movement direction 53, the electrons and neutral gas travels a path such as the movement directions 51, 52 and do not reach the area near the ion trap region 60, so that this type of resolution deterioration does not occur even during numerous repeated measurements. Moreover, the light is irradiated so as to follow the movement direction 52 and therefore must be deflected a further two times in order to reach the detector 25 and so has the property that it is unlikely to be detected as noise. Also, machining identical rod electrodes 7*c* allows mounting the ionization source 30 and the detector 25 in the same direction relative to the linear ion trap. Consequently, also granting the incidental advantages that the entire device may possess a compact design and that wiring is simplified.

Second Embodiment

Figure 4:
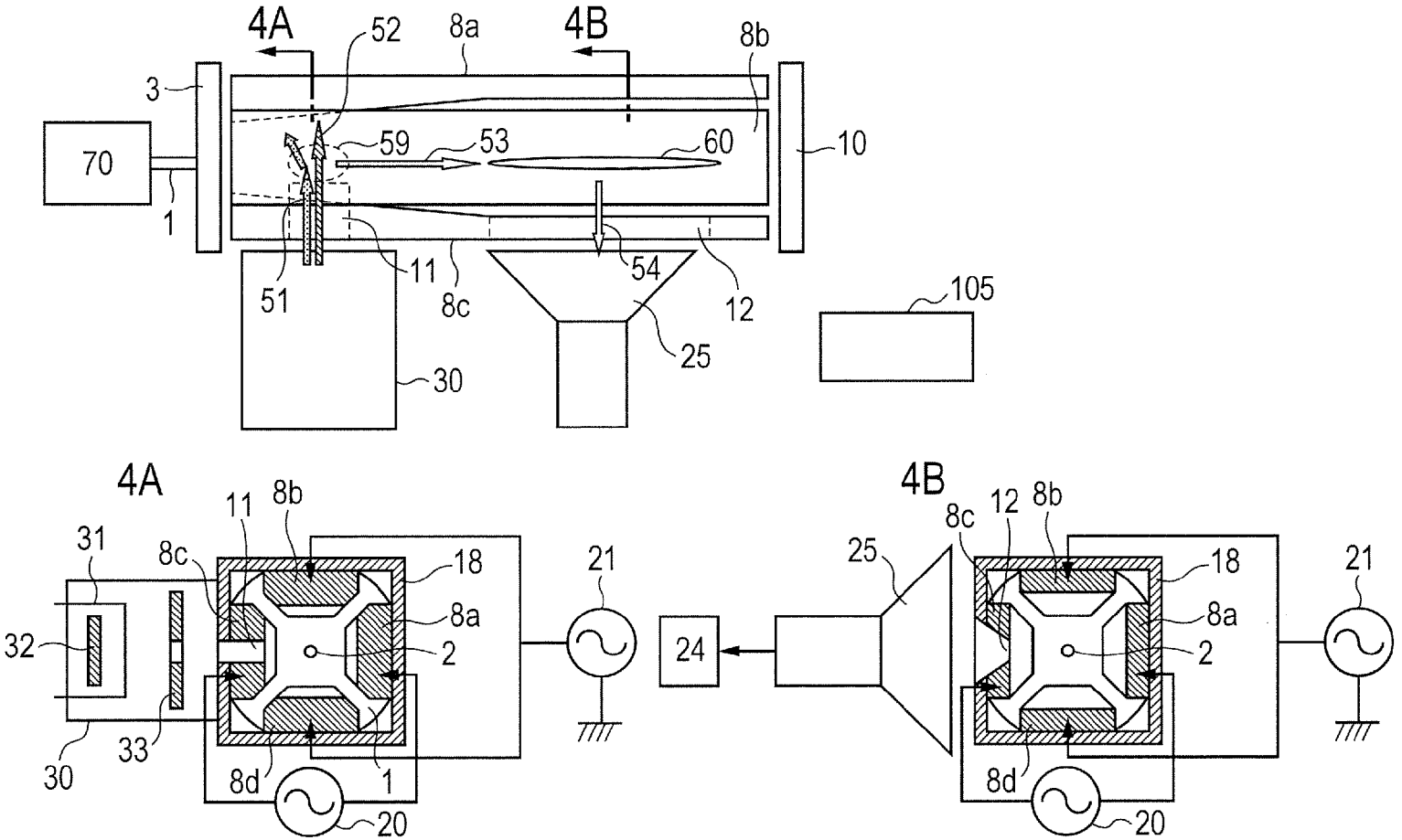
FIG. 4 is a drawing showing a second embodiment of the present method.

FIG. 4 is drawings showing the structure of the linear ion trap of the second embodiment of the present method. The sample inlet and electron injection methods, the measurement sequence, and so on are identical to the first embodiment. However in the present embodiment the square rods 8 are utilized instead of round rods. The square rods 8 are also capable of forming a potential along the axis by changing the minimum distance axially from the center axis to the rods. The present embodiment also provides the advantages that the manufacture and the assembly of the rod electrodes is made easier by employing square rods compared to the first embodiment. On the other hand, the round rods provide higher resolution than square rods.

Third Embodiment

Figure 5:
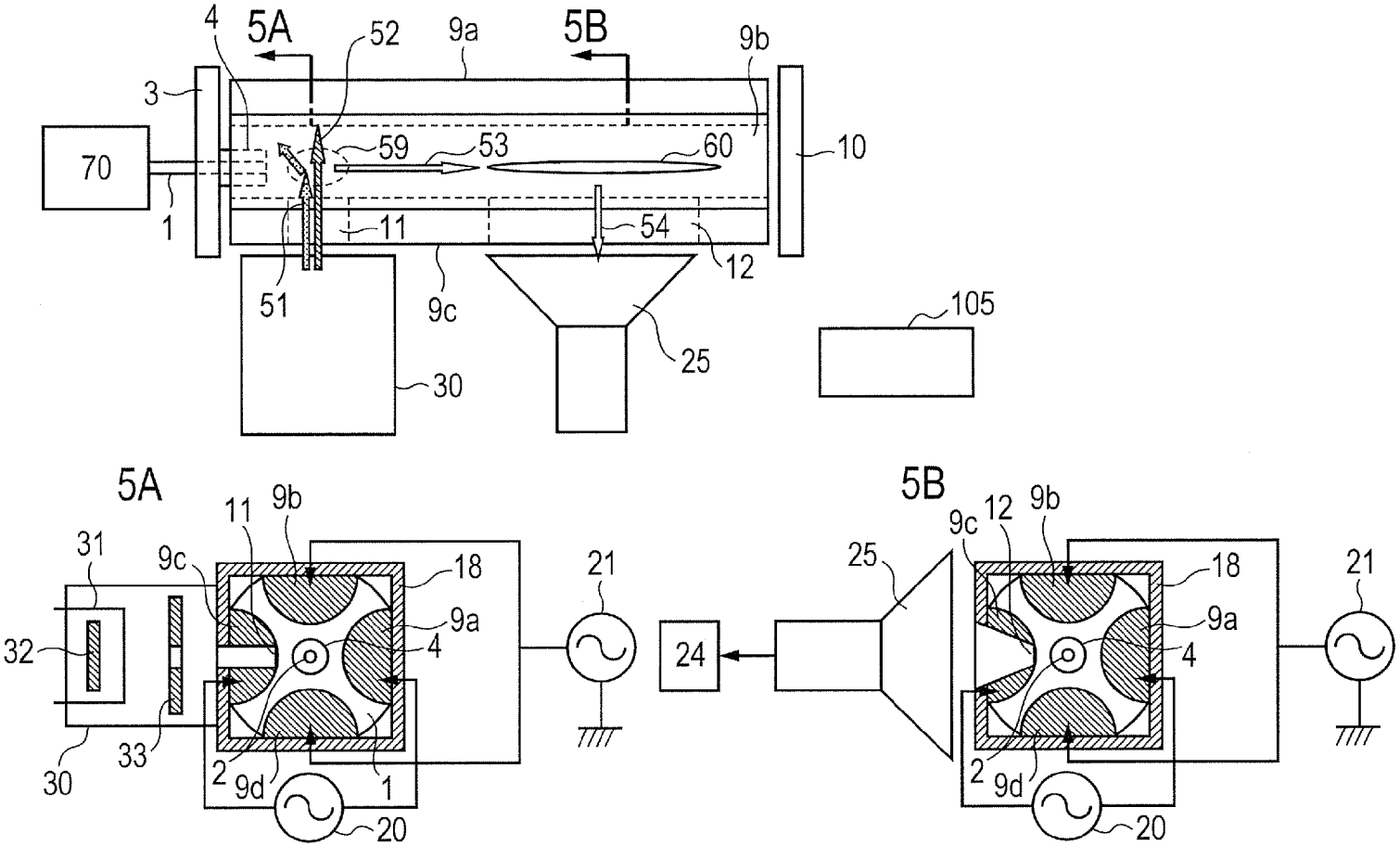
FIG. 5 is a drawing showing a third embodiment of the present method.

FIG. 5 is drawings showing the structure of the linear ion trap of the third embodiment of the present method. The sample inlet (supply), electron injection methods, the measurement sequence, and so on are identical to the first embodiment. In the present embodiment, an extrusion electrode 4 is inserted along the center axis of the rod in order to form an electric field along the axis. In the scanning step, the ions are pushed along the axis to the endcap electrode side by applying a voltage between several dozen volts to several hundred volts to the extrusion electrode 4.

Besides the above described method, various other methods maybe utilized including for example, mounting a ring-shaped electrode on the outer circumference of the linear trap or inserting an electrode between the rods and applying a voltage. The example utilized in the first embodiment described utilizing rod electrodes whose minimum distances axially from the center axis were different. Here however, rod electrodes maybe utilized that are a fixed distance from the center axis. Whatever the method, the effect of the present invention can be obtained as long as a mechanism is installed for moving the ions along the axis to the endcap side.

Fourth Embodiment

Figure 6:
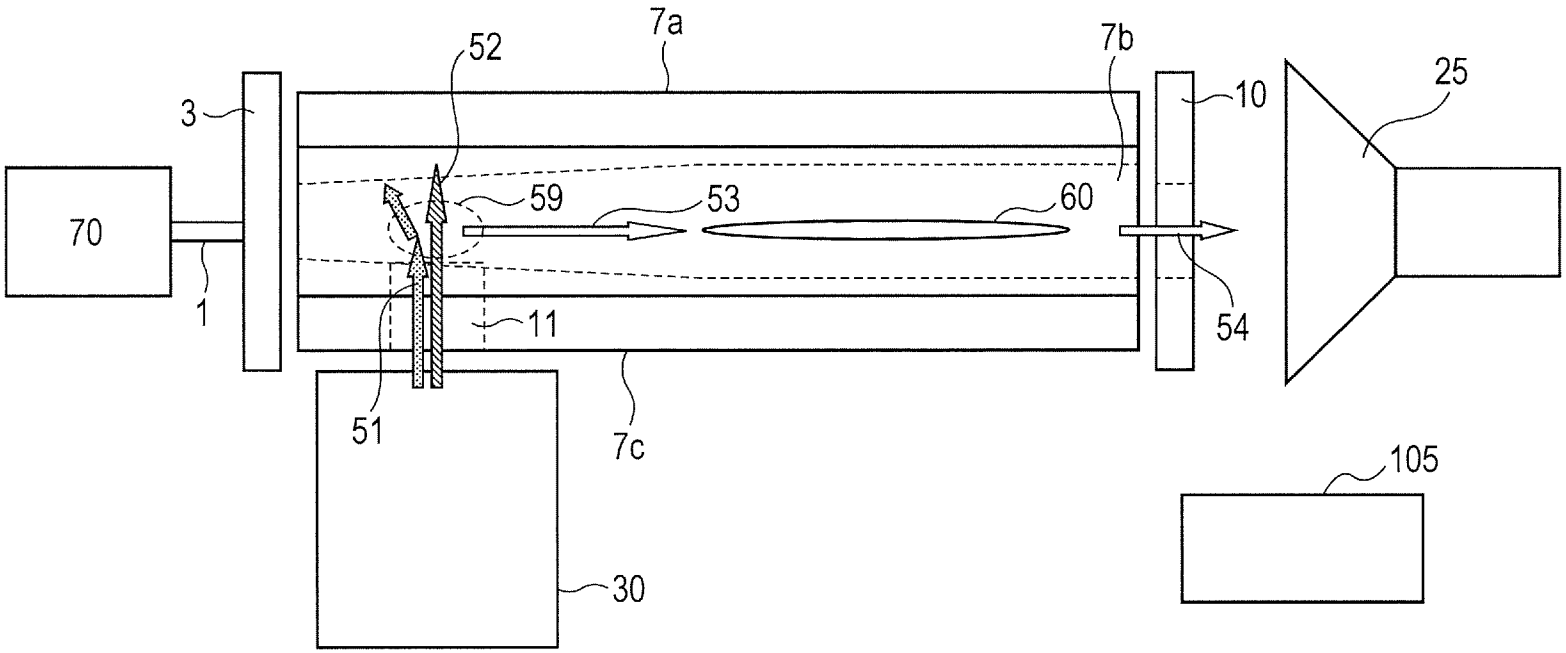
FIG. 6 is a drawing showing a fourth embodiment of the present method.

FIG. 6 is a drawing showing the structure of the linear ion trap of the fourth embodiment of the present method. The sample inlet (supply), electron injection methods, the measurement sequence, and so on are identical to the first embodiment, however in the fourth embodiment the ions are ejected along the axis and not the radius. An orifice 54 is therefore formed on the endcap electrode 10. Installing mesh (not shown in the drawing) in the orifice can help prevent the high voltage applied to the detector from disturbing the electric field within the linear ion trap. During the ion ejection a voltage from several to several dozen volts is set as the endcap electrode 54 voltage. The ions excited by the supplemental AC voltage are extracted along the axial direction by a fringing field formed between the endcap electrode and the rod electrodes in the vicinity of the endcap electrodes and detected in the detector 25. A different method for example may include ejecting the ions selectively by mass along the axis by forming a direct current extraction field across two wire electrodes among the rod electrodes. Even during this type of axial ejection, the same effect of the present invention which is the maintaining of high resolution can be achieved.

Fifth Embodiment

Figure 7:
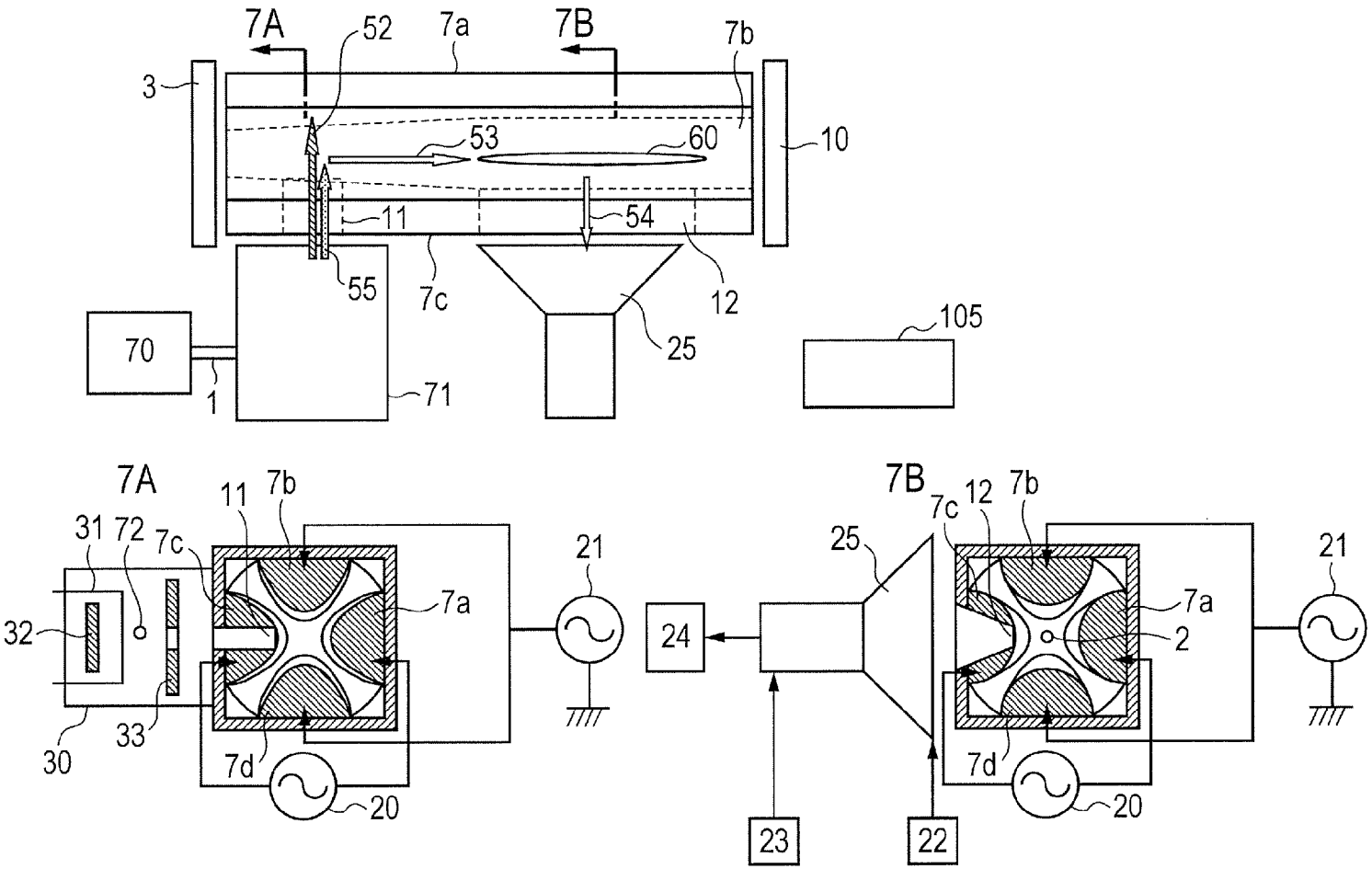
FIG. 7 is a drawing showing a fifth embodiment of the present method.

FIG. 7 is drawings showing the structure of the linear ion trap of the fifth embodiment of the present method. The measurement sequence, the rod electrodes and the placement of the detector and so on are identical to the first embodiment, however in the fifth embodiment, ions and not electrons are injected into the linear ion trap. A sample gasified by a gas sampling unit 70 is supplied by way of a capillary 1 from the orifices 72 to the ionization source 71. The ionization source 71 is comprised of an electrode 32, a lens 33, and a filament 31 such as tungsten wire. The ions generated within ionization source pass through the orifices 11 formed in the rod electrode, and are supplied into the linear ion trap. Ions supplied as along the movement direction 55 are first trapped by the quadrupole electric field and then moved along the movement direction 53 by the electric field along the axial direction, and accumulated in the ion trap region 60. The subsequent detection method is identical to the first embodiment. This embodiment also renders a large effect when the present invention is utilized in the case of contamination of the rod electrodes in the vicinity of the ionization source due to the linearity of the neutral noise along the movement direction 52. The example in FIG. 7 utilized an electron impact ionization source but the embodiment is also fully applicable to ionization sources in a vacuum such as utilizing chemical ionization, photo ionization, and plasma ionization sources.

Sixth Embodiment

Figure 8:
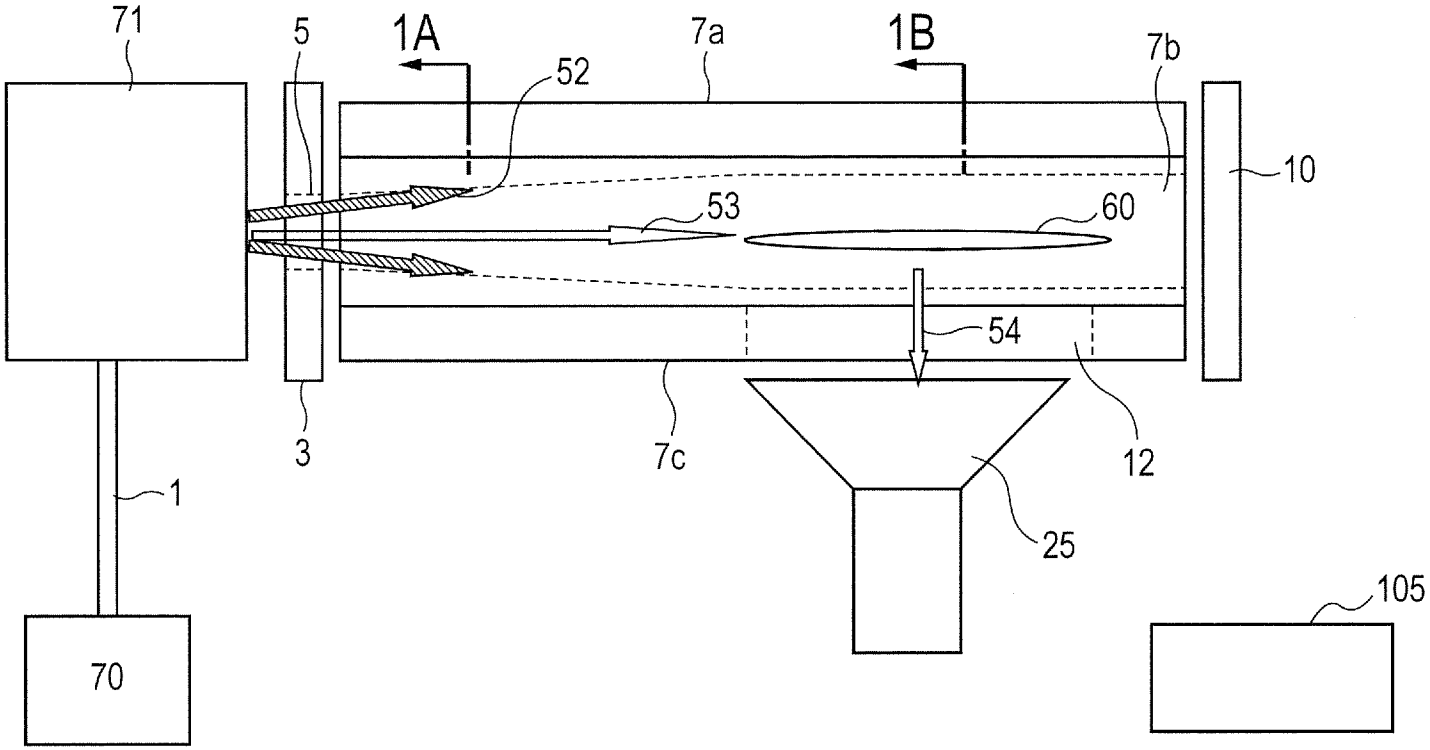
FIG. 8 is a drawing showing a sixth embodiment of the present method.

FIG. 8 is a drawing showing the structure of the linear ion trap of the sixth embodiment of the present method. The measurement sequence, the rod electrodes and the placement of the detector and so on are identical to the fifth embodiment, however in the sixth embodiment the ionization source 71 is mounted along the axial direction. In contrast to the structure of the fifth embodiment where the ion supply efficiency is approximately 10% due to the need to surmount the barrier imposed by the RF electric field from the ionization source to the linear ion trap, the structure of the sixth embodiment only utilizes a DC electric field from the ionization source 71 to the linear ion trap so that a value near 100% can be obtained for the ion supply efficiency. This embodiment also renders a large effect when employed in the present invention as a countermeasure to contamination of the rod electrodes in the vicinity of the ion source from the linear progression of neutral noise along the movement direction 52.

Seventh Embodiment

Figure 9:
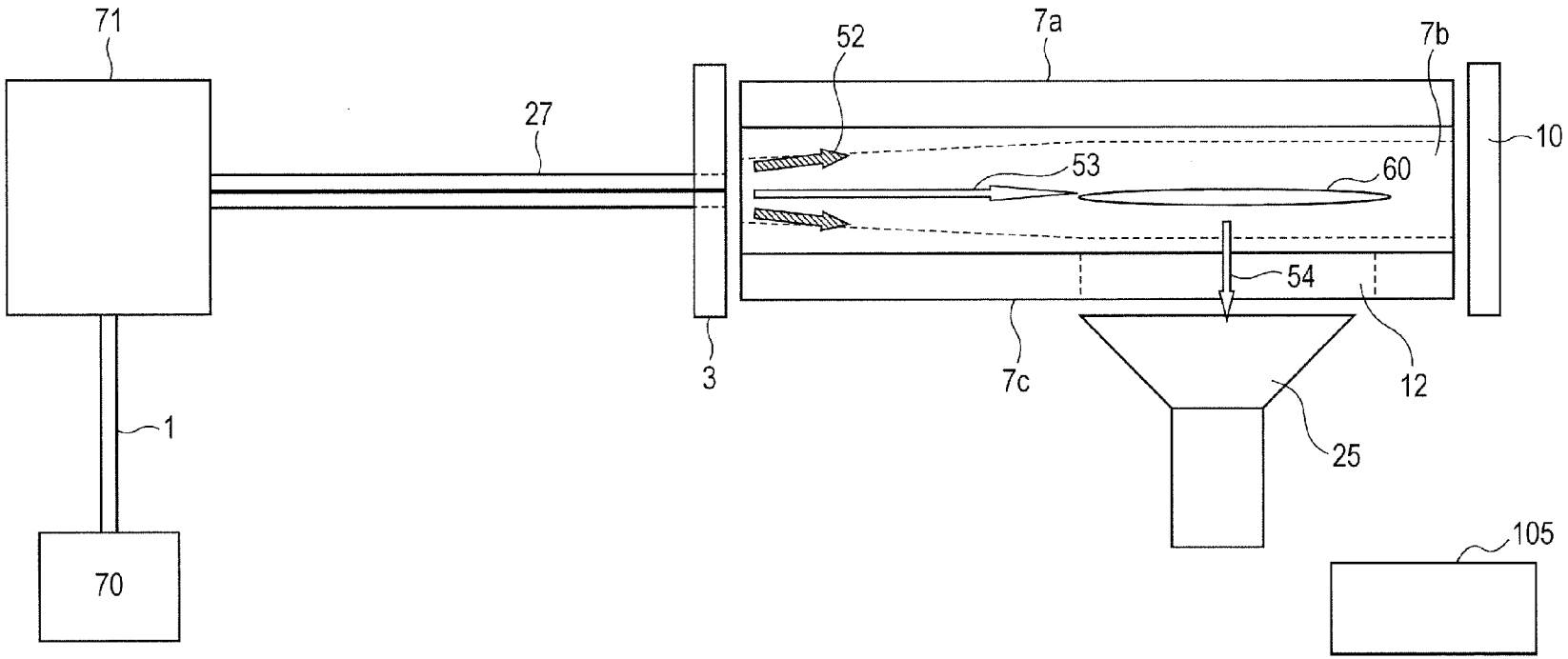
FIG. 9 is a drawing showing a seventh embodiment of the present method.

FIG. 9 is a drawing showing the structure of the linear ion trap of the seventh embodiment of the present method. The measurement sequence, the rod electrodes and the placement of the detector and so on are identical to the fifth embodiment, however in the seventh embodiment an atmospheric pressure ionization source is utilized as the ionization source 71. The structure of the present embodiment is capable of utilizing various atmospheric pressure ionization sources such as electrospray ionization sources and atmospheric pressure chemical ionization sources. A capillary 27 is installed between the atmospheric ionization source and the linear ion trap in order to maintain a vacuum. This embodiment also renders a large effect when the present invention is employed as a countermeasure to contamination of the rod electrodes in the vicinity of the ion source from the linear progression of neutral noise along the movement direction 52. There are various methods aside from the present embodiment for supplying ions at atmospheric pressure into the linear ion trap however applying the present invention will still prove effective for those methods.

In all of the above embodiments, plating the surface of the rod electrode with gold, and so on the same as implemented in the related art for preventing contamination from adhering will prove effective for improving durability.

The structure shown in the first, second, and third embodiments showed a structure that only applied the trap RF voltage to a pair of rod electrodes (7*b*, 7*d*). This type of structure is preferable for enhancing electron efficiency in the first, second, third, fourth, and fifth embodiments that input electrons and ions radially. However, a trap RF voltage of an opposite phase can be applied to another pair of rod electrodes (7*a*, 7*c*). This voltage application scheme is preferable for enhancing the ion supply efficiency in the sixth and seventh embodiments that supply the ions from along the axis.

Figure 10:
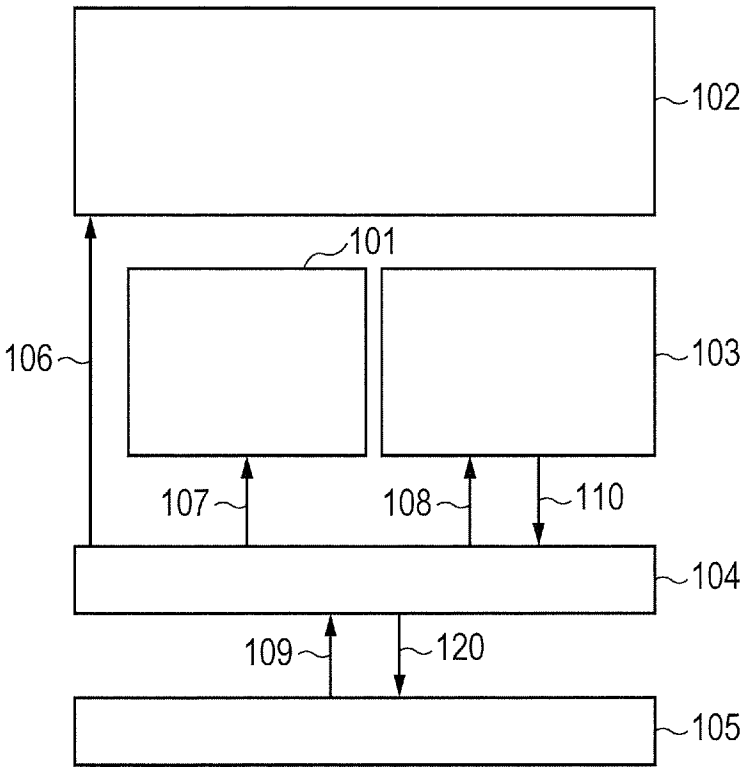
FIG. 10 is a drawing showing an example of placement method.

In the first, second, third, and fifth embodiments, the ionization source and the detector are mounted along the same direction as the linear ion trap. The advantages provided by this arrangement are described while referring to FIG. 10. A control voltage 109 output from the control unit of the control unit/data collector unit 105 is applied by way of a connector unit 104 to the ionization source 101, the linear ion trap unit 102, and the detector 103. Moreover, the signal 110 generated by the detector 103 is sent by way of the connector unit 104 to the data collector unit of the control unit/data collector unit 105. The overall volumetric size can be made compact by mounting the ionization source 101 and the detector 103 to one side of the linear ion trap 102 as shown in FIG. 10. Utilizing this arrangement provides the advantage that the wiring is simple even if the connector unit is mounted to one side.

LIST OF REFERENCE SIGNS

1 . . . Capillary, 2 . . . Orifice, 3 . . . Incap electrode, 4 . . . Extrusion electrode, 7 . . . Rod electrode, 8 . . . Rod electrode, 9 . . . Rod electrode, 10 . . . Endcap electrode, 11 . . . Supply orifice, 12 . . . Ejection orifice, 18 . . . Cover, 20 . . . Supplemental AC voltage, 21 . . . Trap RF voltage, 24 . . . Data collector unit, 27 . . . Capillary, 30 . . . Electron source, 31 . . . Filament, 32 . . . Electrode, 33 . . . Lens, 51 . . . Electron movement direction, 52 . . . Linear component movement direction, 53 . . . Ion movement direction, 54 . . . Ion ejection direction, 55 . . . Ion ejection direction, 59 . . . Ionizing region, 60 . . . Ion trap region, 70 . . . Sampling unit, 71 . . . Ionization source, 72 . . . Orifice, 74 . . . Ionization source, 101 . . . Ionization source, 102 . . . Linear ion trap unit, 103 .. . Detector, 104 . . . Power supply connector unit, 105 . . . Control section/data collector unit, 106 . . . Control voltage, 107 . . . Control voltage, 108 . . . Control voltage, 109 . . . Control voltage, 110—Signal.

The invention claimed is:

1. A mass spectrometer comprising:

a linear ion trap unit, including a multi-polar rod electrode containing a rod electrode formed with an orifice configured to allow passage of electrons or ions, wherein the multi-polar rod electrode includes single axis electrodes;

an ion movement mechanism, configured to move ions within the linear ion trap unit along an axial direction of the multi-polar rod electrode, wherein the ion movement mechanism includes an axial electrical field generated by the multi-polar rod electrode at different minimum distances axially from the center axis;

a detector, configured to detect ions elected selectively by mass from the linear ion trap unit; and an electron source configured to generate electrons to supply into the linear ion trap unit, wherein the orifice is configured to supply electrons from the electron source.

2. The mass spectrometer according to claim 1, wherein the rod electrode comprises:

the orifice, configured to allow passage of ions or electrons; and an additional orifice, configured to eject ions selectively by mass.

3. The mass spectrometer according to claim 2, wherein the orifice and the additional orifice are formed in the same rod electrode.

4. The mass spectrometer according to claim 3, further comprising:

a control unit/data collector; and a connector configured to control an input and an output between the control unit/data collector and the linear trap unit or the detector;

wherein the detector, the connector and the control unit/data collector are mounted on the same side relative to the linear ion trap unit.

5. The mass spectrometer according to claim 1, wherein the multi-polar rod electrode includes a round rod electrode.

6. The mass spectrometer according to claim 1, wherein the multiple rod electrode includes a square rod electrode.

7. The mass spectrometer according to claim 1, wherein an area around the linear ion trap unit is covered with insulating material.

8. The mass spectrometer according to claim 1, comprising:

an endcap electrode containing an orifice to eject ions from the edge of the linear ion trap unit, wherein the orifice includes a mesh.

9. A mass spectrometer comprising:

a linear ion trap unit, including a multi-polar rod electrode containing a rod electrode formed with an orifice configured to allow passage of electrons or ions, wherein the multi-polar rod electrode includes single axis electrodes;

an ion movement mechanism, configured to move ions within the linear ion trap unit along an axial direction of the multi-polar rod electrode, wherein the ion movement mechanism includes an axial electrical field generated by the multi-polar rod electrode at different minimum distances axially from the center axis;

a detector, configured to detect ions elected selectively by mass from the linear ion trap unit; and an ionization source configured to generate ions to supply into the linear ion trap unit, wherein the orifice is configured to supply ions from the ionization source.

10. The mass spectrometer according to claim 9, wherein the rod electrode comprises:

the orifice, configured to allow passage of ions or electrons; and an additional orifice, configured to eject ions selectively by mass.

11. The mass spectrometer according to claim 10, wherein the orifice and the additional orifice are formed in the same rod electrode.

12. The mass spectrometer according to claim 11, further comprising:

a control unit/data collector; and a connector configured to control an input and an output between the control unit/data collector and the linear trap unit or the detector;

wherein the detector, the connector and the control unit/data collector are mounted on the same side relative to the linear ion trap unit.

13. The mass spectrometer according to claim 9, wherein the multi-polar rod electrode includes a round rod electrode.

14. The mass spectrometer according to claim 9, wherein the multiple rod electrode includes a square rod electrode.

15. The mass spectrometer according to claim 9, wherein an area around the linear ion trap unit is covered with insulating material.

16. The mass spectrometer according to claim 9, comprising:

an endcap electrode containing an orifice to eject ions from the edge of the linear ion trap unit, wherein the orifice includes a mesh.

17. A mass spectrometry comprising the steps of:

passing electrons or ions through an orifice formed in at least one of a plurality of multi-polar rod electrodes configuring a linear ion trap unit, wherein the multi-polar rod electrodes include single axis electrodes;

generating an axial electric field by the multi-polar rod electrodes at different minimum distances axially from the center axis in the linear ion trap unit, and moving the ions within the ion trap unit along an axial direction in order to trap the ions;

electing the ions, selectively by mass, from the linear ion trap unit; and detecting the elected ions;

wherein the step of passing electrons or ions through an orifice is a step of supplying electrons, and includes a step of ionizing a specimen gas supplied from the edge of the linear ion trap unit, in the interior of the linear ion trap unit.

18. The mass spectrometry according to claim 17, further comprising the steps of:

isolating the ions trapped within the linear ion trap unit; and dissociating the isolated ions, wherein the dissociated ions are ejected mass-selectively.

19. A mass spectrometry comprising the steps of:

passing electrons or ions through an orifice formed in at least one of a plurality of multi-polar rod electrodes configuring a linear ion trap unit, wherein the multi-polar rod electrodes include single axis electrodes;

generating an axial electric field by the multi-polar rod electrodes at different minimum distances axially from the center axis in the linear ion trap unit, and moving the ions within the ion trap unit along an axial direction in order to trap the ions;

electing the ions, selectively by mass, from the linear ion trap unit; and detecting the elected ions;

wherein the step of passing electrons or ions through an orifice is a step of supplying ions.

20. The mass spectrometry according to claim 19, further comprising the steps of:

isolating the ions trapped within the linear ion trap unit; and dissociating the isolated ions, wherein the dissociated ions are ejected mass-selectively.

21. A mass spectrometer comprising:

a linear ion trap unit, including a multi-polar rod electrode containing a rod electrode formed with an orifice configured to allow passage of electrons or ions;

a ion movement mechanism, configured to move ions within the linear ion trap unit along an axial direction of the multi-polar rod electrode;

a detector, configured to detect ions elected selectively by mass from the linear ion trap unit; and an electron source configured to generate electrons to supply into the linear ion trap unit, wherein the orifice is configured to supply electrons from the electron source.

22. The mass spectrometer according to claim 21, wherein the rod electrode comprises:

the orifice, configured to allow passage of ions or electrons; and an additional orifice, configured to eject ions selectively by mass.

23. The mass spectrometer according to claim 22, wherein the orifice and the additional orifice are formed in the same rod electrode.

24. The mass spectrometer according to claim 23, further comprising:

a control unit/data collector; and a connector configured to control an input and an output between the control unit/data collector and the linear ion trap unit or the detector;

wherein the detector, the connector and the control unit/data collector are mounted on the same side relative to the linear ion trap unit.

25. A mass spectrometer comprising:

a linear ion trap unit, including a multi-polar rod electrode containing a rod electrode formed with an orifice configured to allow passage of electrons or ions;

a ion movement mechanism, configured to move ions within the linear ion trap unit along an axial direction of the multi-polar rod electrode;

a detector, configured to detect ions elected selectively by mass from the linear ion trap unit; and an ionization source configured to generate ions to supply into the linear ion trap unit, wherein the orifice is configured to supply ions from the ionization source.

26. The mass spectrometer according to claim 25, wherein the rod electrode comprises:

the orifice, configured to allow passage of ions or electrons; and an additional orifice, configured to eject ions selectively by mass.

27. The mass spectrometer according to claim 26, wherein the orifice and the additional orifice are formed in the same rod electrode.

28. The mass spectrometer according to claim 27, further comprising:

a control unit/data collector; and a connector configured to control an input and an output between the control unit/data collector and the linear ion trap unit or the detector;

wherein the detector, the connector and the control unit/data collector are mounted on the same side relative to the linear ion trap unit.

* * * * *